US005868183A

United States Patent [19]

Kozyrski et al.

[11] Patent Number: 5,868,183

[45] Date of Patent: Feb. 9, 1999

[54] SUPPORT ASSEMBLY FOR ANGULAR ORIENTATION OF AN ELONGATE MEMBER

[75] Inventors: Vincent T. Kozyrski, Plainville, Conn.; William Hursey, Picayune, Miss.; Wayne Hawk, Glastonbury, Conn.

[73] Assignee: The Fletcher-Terry Company, Farmington, Conn.

[21] Appl. No.: 956,516

[22] Filed: Oct. 23, 1997

Related U.S. Application Data

[63] Continuation of Ser. No. 612,217, Mar. 7, 1996, Pat. No. 5,697,415.

[51] Int. Cl.[6] ..... B27C 5/00

[52] U.S. Cl. ..... 144/136.1; 144/84; 144/136.95; 144/371; 144/353; 269/289 R; 269/291; 269/315

[58] Field of Search ..... 269/289 R, 290, 269/291, 303, 307, 315; 248/676, 678; 409/180, 181, 182; 144/82, 83, 84, 136.1, 136.95, 137, 154.5, 353, 371

[56] References Cited

U.S. PATENT DOCUMENTS

| | | | |
|---|---|---|---|
| 4,742,856 | 5/1988 | Hehn et al. | 409/182 |
| 5,715,878 | 2/1998 | Ondish | 269/56 |

*Primary Examiner*—W. Donald Bray
*Attorney, Agent, or Firm*—Ira S. Dorman

[57] ABSTRACT

A machine for routing end portions of frame pieces produces a channel that extends with increasing spacing from the bevelled face of the frame piece. Structure on the machine supports the frame piece in a plane that converges toward the plane in which the router bit lies, and cutting is carried out by effecting either curvilinear or rectilinear relative movement of the router and the frame piece or pieces.

6 Claims, 7 Drawing Sheets

80
84
12
20
18
70
68
16
F
80
84
X
76
82
22
78
24
72
74
30
34
46
36
64
32
26
66
81
42
86
28
88
56
61
52
60
50
14
48
10

FIG. 10
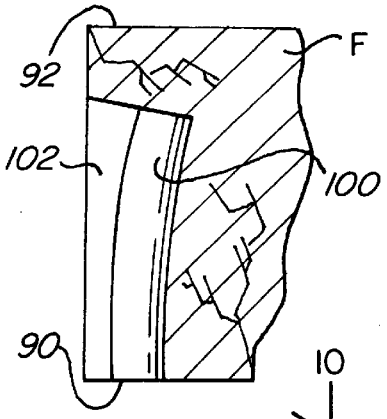
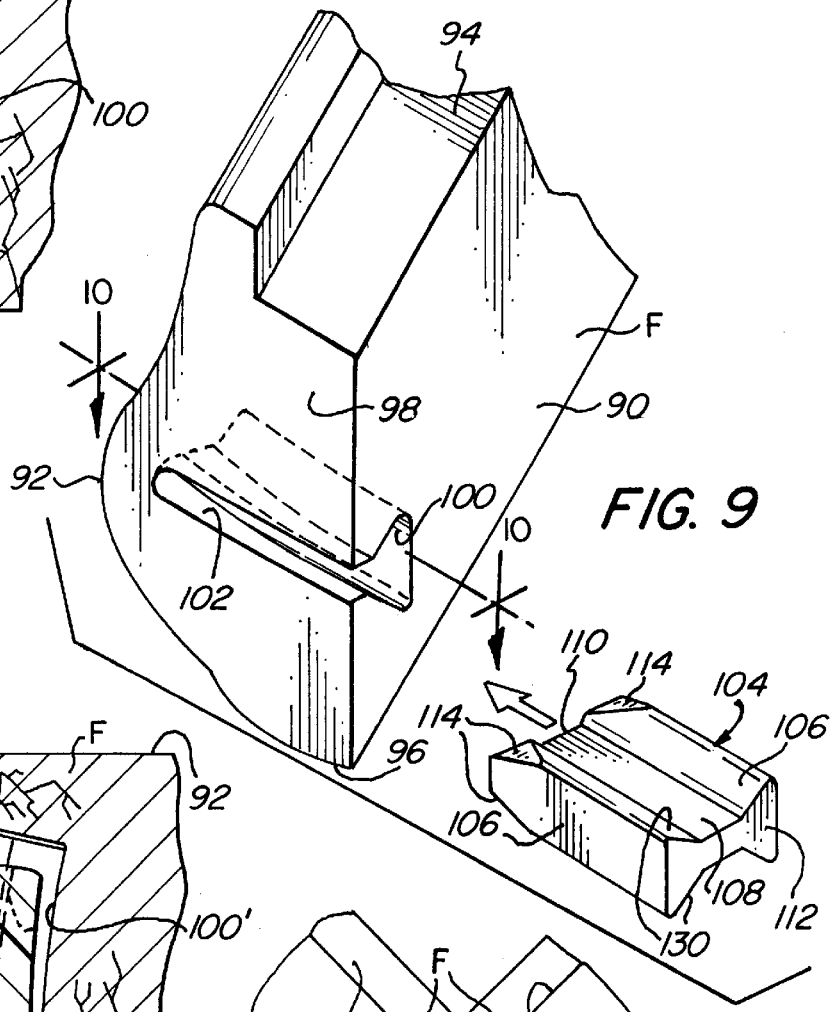
FIG. 9
FIG. 12
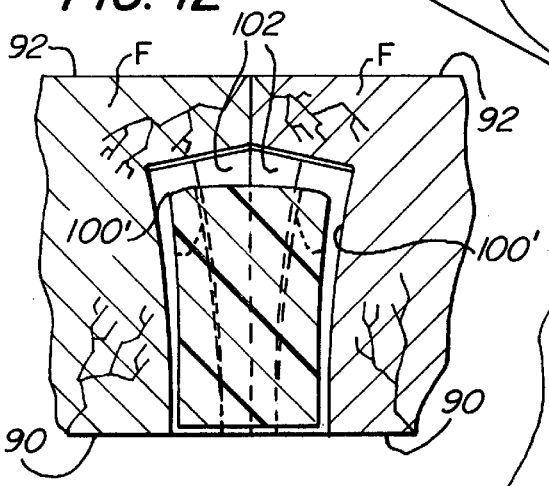
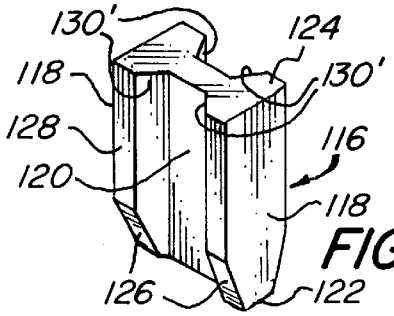
FIG. 13
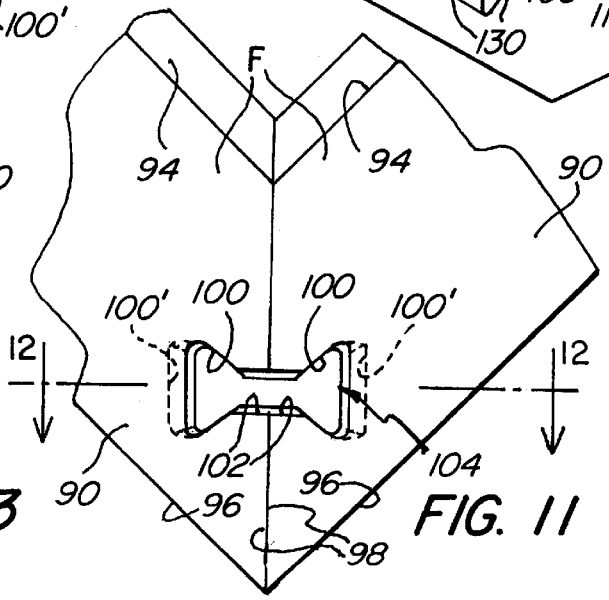
FIG. 11

SUPPORT ASSEMBLY FOR ANGULAR ORIENTATION OF AN ELONGATE MEMBER

This application is a continuation of application Ser. No. 08/612,217, filed Mar. 7, 1996, and now issued as U.S. Pat. No. 5,697,415.

BACKGROUND OF THE INVENTION

It is common practice to join component pieces for constructing picture frames and the like by inserting connecting pegs, wedges, or other fasteners into cooperating channels formed into contiguous end portions of the frame pieces. Exemplary of the prior art in this field are the following U.S. patents:

| | |
|---|---|
| Linscott No. 111,128 | Snitzer et al No. 4,290,371 |
| Fulghum et al No. 497,915 | Logan. No. 4,438,578 |
| Lobo No. 1,061,855 | Wallace No. 4,493,583 |
| Cordes No. 1,165,155 | Wright No. 4,632,160 |
| Jensen No. 1,537,678 | Wright No. 4,715,415 |
| Scianna No. 2,455,097 | Hehr et al No. 4,742,856 |
| Purviance No. 2,735,146 | Wright No. 4,858,664 |
| Miller No. 3,336,689 | Wright No. 4,936,360 |
| Agee No. 3,425,721 | Cox No. 5,090,835 |
| Jungers et al No. 4,142,342 | Rapayelian No. 5,149,236 |
| Bowen et al No. 4,275,972 | Cox Des. 309,985 |

In so constructing frames, it is a matter of fundamental concern to eliminate, or to at least minimize, the presence of gaps between adjacent frame pieces, which are unsightly and tend to compromise the strength of the frame. Numerous channel and fastener designs and structures have been proposed in an effort to achieve a tight and secure joint between frame members; nevertheless, the need has not been satisfied adequately.

SUMMARY OF THE INVENTION

Accordingly, it is a broad object of the invention to provide a novel machine for cutting channels in end portions of frame pieces, which pieces are to be assembled with one another utilizing a connecting peg or fastener.

A related more specific object is to provide such a machine which is adapted to cut channels of unique character, which channels cooperate in a highly effective manner with a peg fastener in producing a tight joint between adjacent frame pieces.

Another related object is to provide such a machine which is of relatively uncomplicated design, is of economical manufacture, and is facile and convenient to employ.

It is also a broad object of the invention to provide a novel method for cutting channels of unique character into end portions of frame pieces, which channels cooperate in a highly effective manner with a peg fastener to produce a tight joint in assembly thereof.

A related object is to provide such a method which is relatively uncomplicated, facile, and convenient to employ.

It has now been found that certain of the foregoing and related objects of the invention are attained by the provision of a machine for cutting channels in end portions of elongate frame pieces, comprising a motor mount having means for mounting a motor with a cutting bit disposed for rotation on a first axis lying in a cutting plane, support means, and base means. The support means is constructed for supporting at least one elongate frame piece adjacent the motor mount for cutting of an end portion of the frame piece so as to form a fastening peg-receiving channel. At least one component of the support means provides first and second surface portions disposed respectively in first and second mutually perpendicular planes and configured for supporting an abutted frame piece thereagainst, the "first" plane being perpendicular to the cutting plane and the "second" plane converging toward the cutting plane in the direction of the motor mount. The base means serves to support the motor mount and the support means for relative movement for cutting such channels into frame pieces so supported; movement may be on either a rectilinear or a curvilinear axis. The machine enables cutting of a frame that is so supported upon the "one" component of the support means as to have its outside surface abutted against the "first" surface portion and its rear surface abutted against the "second" surface portion thereof, the plane of its bevelled end face being disposed substantially normal to the first axis. Cutting is achieved by effecting relative movement of support means and motor mount (and consequently, of the motor and cutting bit) in the manner described. The channel so produced will lie on a path that extends, either curvilinearly or rectilinearly, both forwardly (from the rear surface of the frame piece, in its thickness direction) and also away from the end face (in the length direction) of the frame piece.

The "second" surface portion of the "one" component of the support means will usually be a planar surface. The support means may comprise at least a second component that is disengageably mounted on the "one" component, with the "one" and "second" components providing elements lying on the "second" plane and cooperatively providing the necessary support for an abutted frame piece. More particularly, the support means may comprise a base component and a projecting fence component, cooperatively providing the "one" component. Such a fence component will generally have two opposite sides, one side comprising the "second" surface portion of the "one" component and the other comprising a third surface portion, the fence component being so positioned as to have an area of the "first" surface portion disposed to each of its opposite sides. The "third" surface portion will be disposed in a third plane that converges toward the cutting plane and the "second" plane, in the direction of the motor mount.

Generally, the "second" and "third" surface portions will both be planar surfaces. In those instances in which the support means is two-sided and includes a "second" component disengageably mounted on the fence component, the "second" component will desirably be a U-shaped piece dimensioned and configured to seat on the fence component (usually in inverted position) to provide at least one supporting element lying in each of the "second" and the "third" planes.

Additional object of the invention are attained by the provision of a method for cutting channels in end portions of frame pieces, utilizing apparatus of the character described. In carrying out the method, a frame piece is supported upon the one component of the support means with its outside surface abutted against the first surface portion and its rear surface abutted against the second surface portion thereof, and with the plane of its bevelled end face disposed substantially normal to the first axis. Relative movement of the support means and the motor is so effected as to cause the cutting bit to cut a channel along a path that extends, either curvilinearly or rectilinearly, both forwardly from the rear surface of the frame piece, in its thickness direction, and also away from the end face in the length direction of the frame piece.

Normally, the one component of the support means will provide a third surface portion disposed in a third plane which converges toward the cutting plane and the second plane, in the direction of the motor mount. In such instances, the method may include, as additional steps: providing a second frame piece; supporting the second frame piece upon the one component in the manner described but with its rear surface abutted against the third surface portion; and effecting relative movement of the support means and the motor so as to cause the cutting bit to cut a channel, of the character described, in each of the frame pieces.

BRIEF DESCRIPTION OF THE DRAWINGS

FIG. 9 is an exploded perspective view showing one frame piece having a channel cut in a mitered end portion thereof, and a fastening peg positioned for insertion into the channel to effect assembly with another frame piece;

FIG. 10 is a fragmentary sectional view of the frame piece of FIG. 9, taken along line 10—10 thereof;

FIG. 11 is a view showing the rear of two frame pieces having channels of the character illustrated in FIGS. 9 and 10, held in assembly by a fastening peg inserted into the common recess cooperatively formed by the two aligned channels;

FIG. 12 is a fragmentary sectional view taken along line 12—12 of FIG. 11; and FIG. 13 is a perspective view showing a second form of peg fastener suitable for use in frame assemblies embodying the invention.

DETAILED DESCRIPTION OF THE ILLUSTRATED EMBODIMENTS

Figures 6, 7:
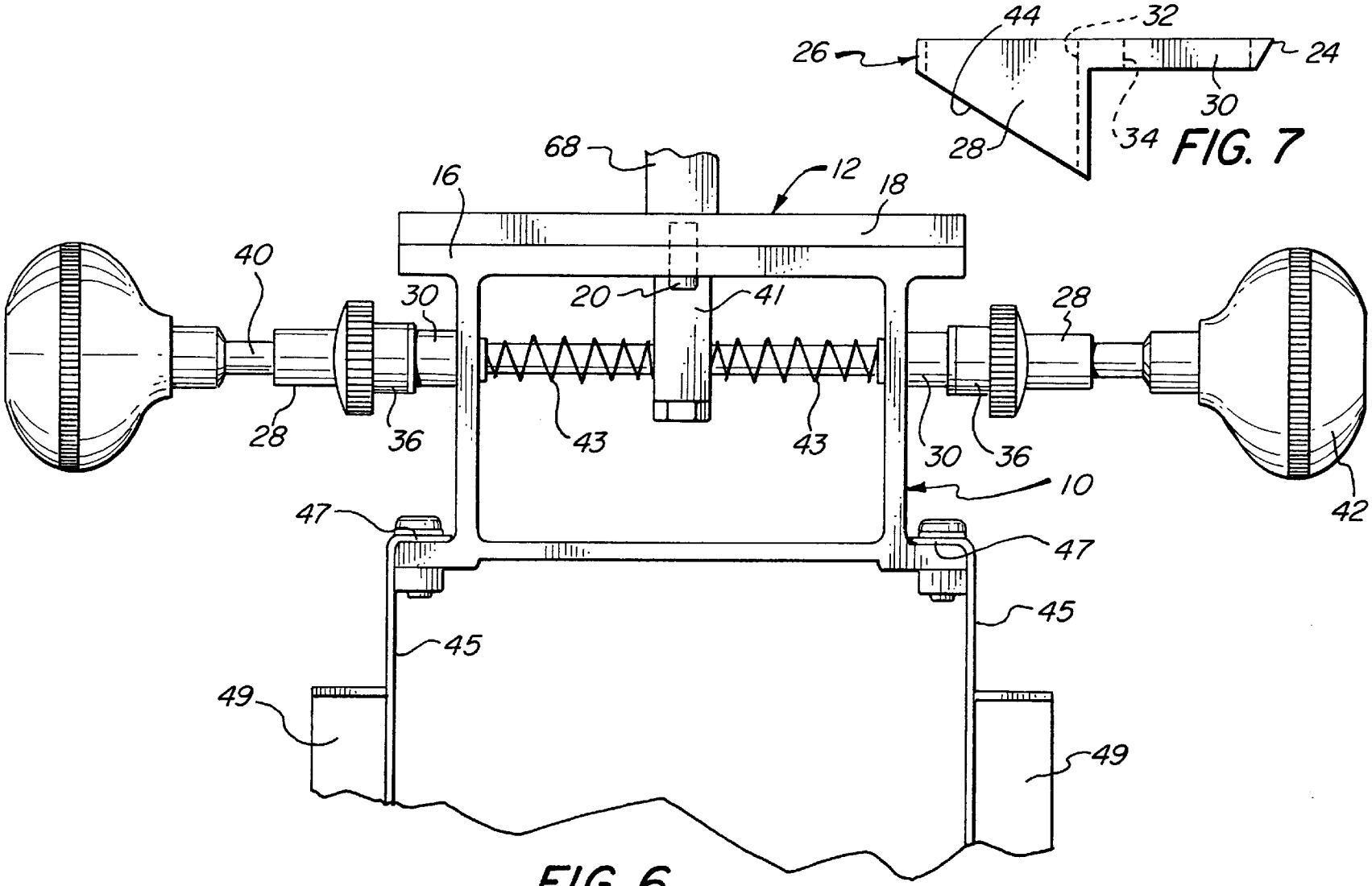
FIG. 6 is a fragmentary rear elevational view of the same machine, drawn to the scale of FIG. 5.
FIG. 7 is a plan view of the cutting depth control member utilized in the machine of the foregoing figures.

Turning now in detail to FIGS. 1–7 of the appended drawings, therein illustrated is a cutting machine embodying the present invention and consisting of a base, a workpiece-supporting table, and a motor mount, generally designated respectively by the numerals 10, 12, and 14. The base 10 has a top wall 16 on which is slidably supported a plate 18 of which the table 12 is constructed, the wall 16 and plate 18 being interconnected (in the form depicted in FIGS. 1–5) by a pin 20 to pivot about a normally vertical axis on the centerline of the machine. The base 10 has opposite sidewalls 22 (only one of which is visible), against which is mounted a depth-control member, generally designated by the numeral 26 and best seen in FIG. 7. The member 26 consists of a wedge-like head element 28 and a rectilinear tail element 30, the elements 28 and 30 being slotted at 32 and 34, respectively. The threaded shaft of a knob-ended clamping screw 36 extends through the slot 34 of the tail element 30, into engagement with a threaded aperture formed in the corresponding wall 22, and serves to secure one of the depth control members 26 in any position along the length of the slot 34, as selected by alignment of the rearward edge 24 of the tail element 30 with an appropriate mark of the adjacent scale 38 (seen in FIG. 5); the scale markings will typically indicate depths of ⅜ inch, ⅝ inch and 15⁄16 inch. An operating rod 40 is connected to the table 12 by an attached block 41, and has opposite end portions that extend through the slots 32 in the head elements 28 (appropriate apertures also being provided in the sidewalls 22); the end portions of the rod 40 terminate in operating knobs 42, and the block 41 is centered by coil springs 43 mounted on the rods (as seen in FIG. 6). As will be appreciated, the knobs 42 come into contact with the inclined faces 44 of the head elements 28 as the table 12 is swung in opposite directions about the pin 20, with the position of the members 26 thereby establishing the limits of travel of the table 12 and thus the depth of cutting (as will be more fully described below).

Figure 4A:
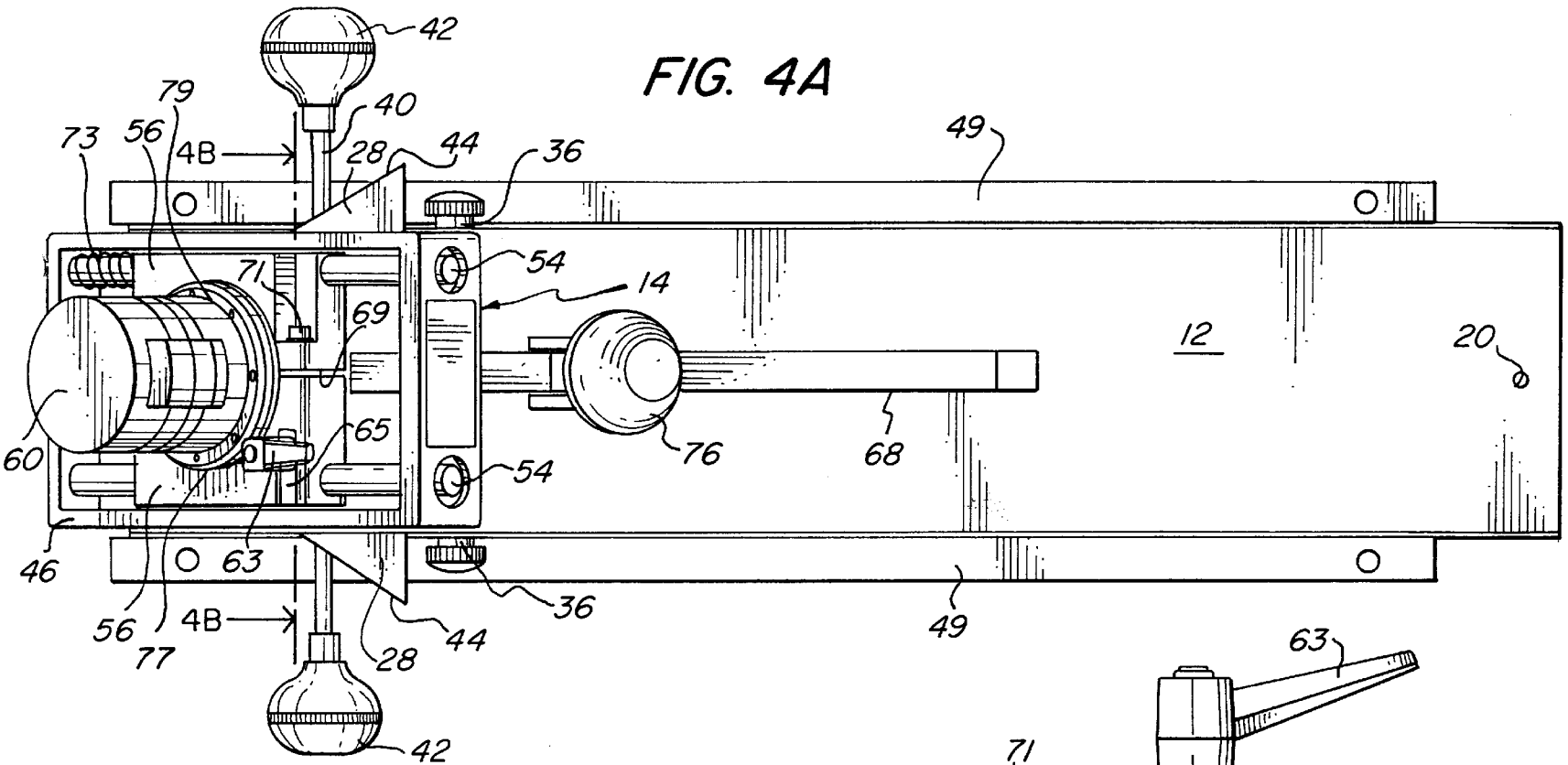
FIG. 4A is a plan view of a machine similar to that of FIG. 1, showing additional features.
Figure 4B:
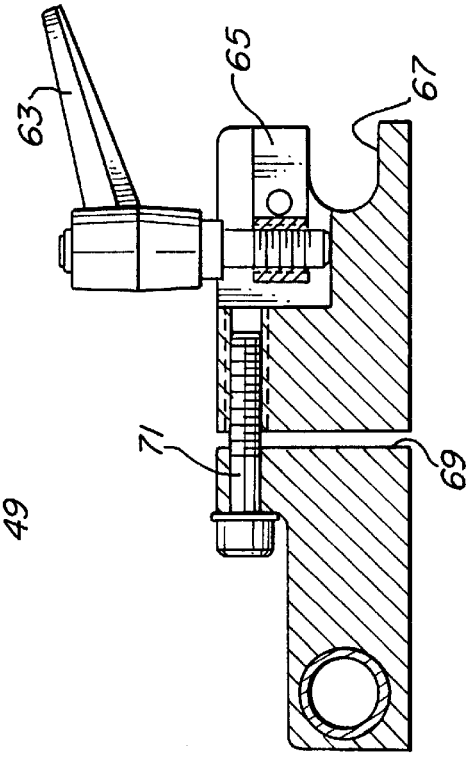
FIG. 4B is a sectional view of the motor mounting block taken substantially along line 4B—4B of FIG. 4A.
Figure 5:
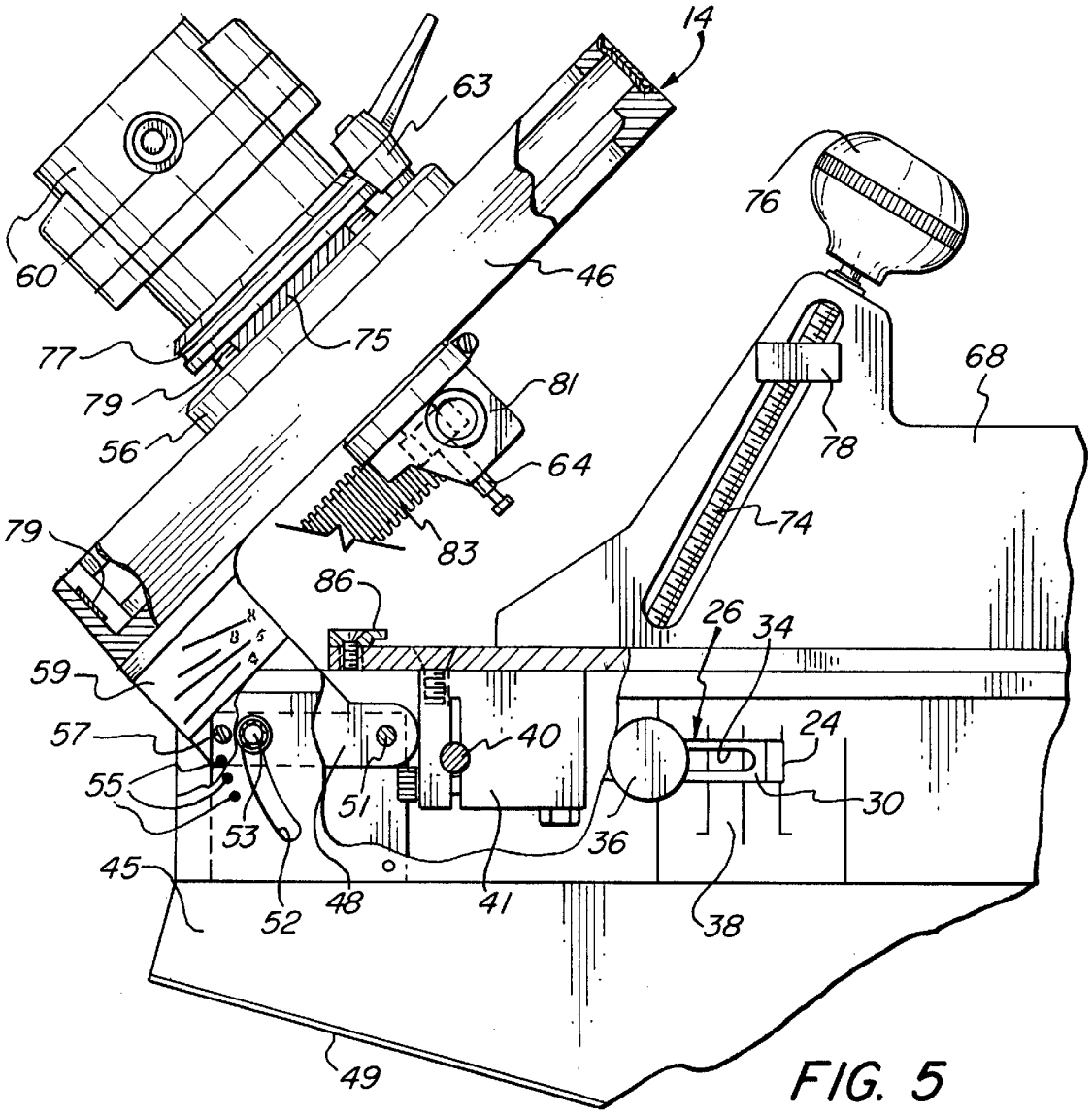
FIG. 5 is a fragmentary elevational view of the forward portion of the machine of FIG. 4A, drawn to an enlarged scale.

As is seen in FIGS. 4–6, supplemental support walls 45 may be attached to the opposite sides of the base 10 by means of upper flanges 47, the lower flanges 49 providing elements for direct support upon an underlying horizontal surface. The resultant ramp will impart a forward declination to the machine (generally at an angle of at least about 15° to horizontal), and will thereby facilitate and promote automatic positioning of frame pieces relative to the cutting bit. Fabricating the plate 18 from a smooth metal, such as anodized aluminum, will also contribute to the effect.

Figures 2, 3:
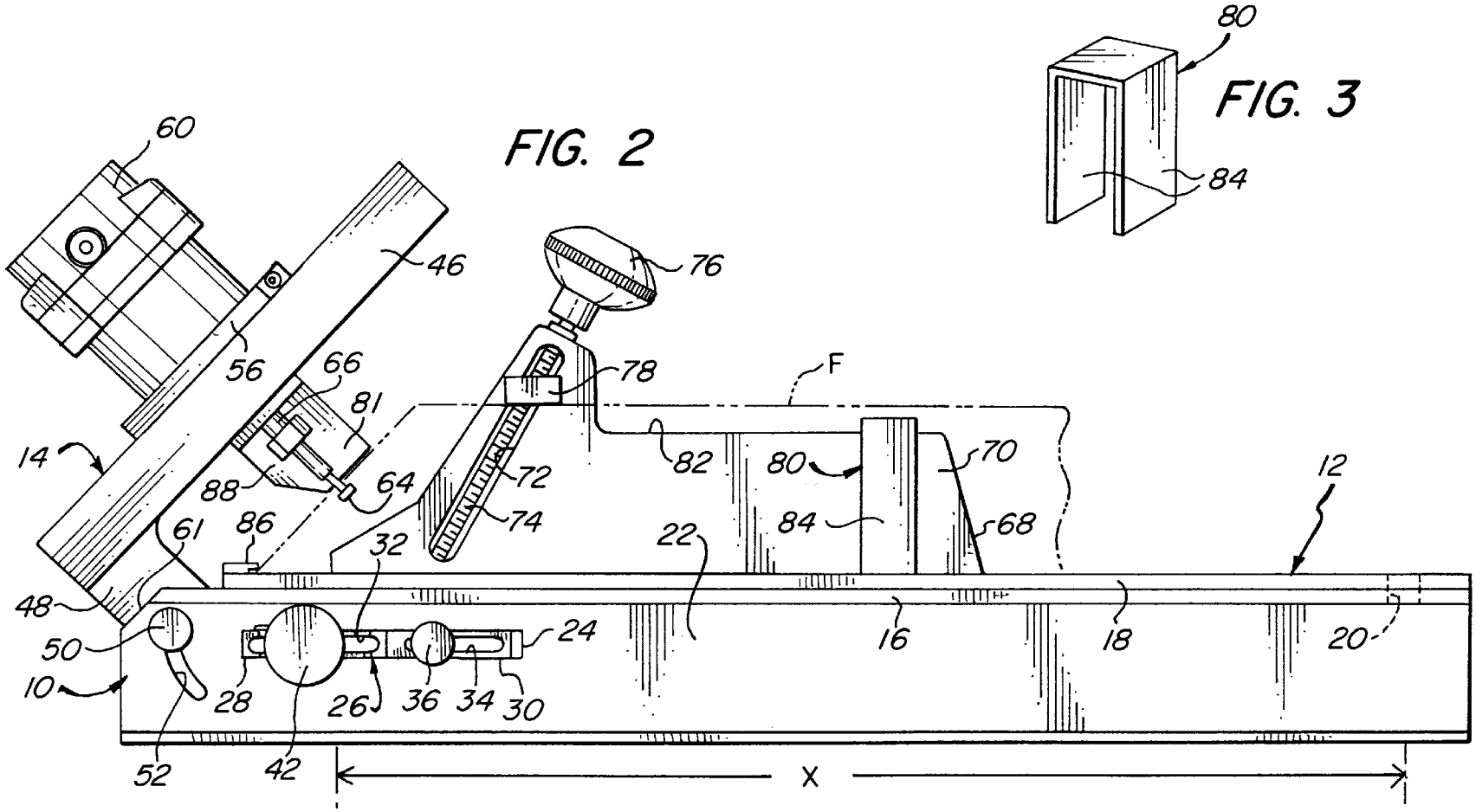
FIG. 2 is a side elevational view of the cutting machine of FIG. 1.
FIG. 3 is a perspective view of a U-shaped implement used with the machine for imparting a forwardly convergent relationship to frame pieces supported thereon.

The motor mount 14 consists of a rectangular frame 46 from which extends a pair of connecting arms 48 (only one of which is again visible in FIGS. 2 and 5). The outer ends of the arms 48 are pivoted to the base 10 on shaft 51, and a fastening knob 50 has a threaded shaft 53 that extends into engagement with each arm 48 through the slot 52 in the respective sidewall 22. Tightening of the knobs 50 will serve to secure the mount in any angular position, pivoted about the axis of the shaft 51, within the limits of the arcuate slots 52.

A detent arrangement is desirably associated with the mounting arms, to indicate positions that are correct for cutting channels in end faces that have been mitered to produce common frame shapes, e.g., rectangular, pentangular, hexangular, and octangular. FIG. 5 shows a series of four detents 55 (only three of which are visible), which cooperate with a spring-loaded ball plunger, mounted at 57, to physically locate each of four positions of pivoting. A label 59 is applied to the arm 48, and corresponds to the detent locations to enable positioning for cutting pieces mitered to form 4-, 5-, 6-, and 8-sided frames, the lines on the scale being employed by reference to the base edge 61; further variation is possible between and beyond the detents.

A pair of guide rods 54 extend parallel to one another between the opposite ends of the frame 46, and slidably support a mounting block 56, the latter being fitted with a lever-operated clamping screw 63 and cooperating pivot lug 65 (seen in FIG. 4B) for disengageably securing it in any position along the length of the rods 54. As will be appreciated, turning of the screw 63, in the tightening direction, will cause the lug 65 to pivot into engagement with the one of the rods 54 that is received in the U-shaped slot 67; a coil spring 73 cushions impact of the block 56 against the bottom of the frame 46, upon release.

A router motor 60 extends through an aperture 58 in the block 56, which is split at 69 to provide opposing portions bridged by a transverse screw 71. A router bit 64 is in turn secured to the shaft 66 of the motor 60 for disposition in the plane (normally vertical) of the center line of the machine.

As will be appreciated, it is necessary to vary the position of the motor 60 along the axis of rotation so as to enable adjustment of the depth of penetration of the bit 64 in the direction normal to the bevelled face of the frame piece, for which purpose the elongate spacer 75, shown in FIG. 5, may be used. More specifically, the router (motor 60 and bit 64) can be displaced outwardly by loosening of the screw 71 to relieve the clamping force generated between the portions of the mounting block 56 defined by the split at 69. In that relationship, the spacer 75 can be inserted between the outer surface of the mounting block 56 and the ring 77, which is internally threaded and engaged on an externally threaded circumferential portion 79 of the motor housing. The ring 77 is turned so as to adjust the axial position of the router, as necessary to bring the tip of the bit 64 into contact with the bevelled face of the frame piece. After removal of the spacer, sliding the motor inwardly will position the bit so as to cut to a depth equal to the spacer width, whereupon the screw 71 will be tightened to maintain the desired relationship. A set of spacers, corresponding to standard depths of cutting, may of course be provided.

It will be noted that a magnetic element 79 is secured to the frame 46, for convenient storage of the spacer when it is not in use, and that a small hood or shield 81 surrounds the bit 64. A vacuum duct 83 is connected to the shield 81, which can therefore serve not only as a protective guard, for safety purposes, but also as means for concentrating the vacuum effect for efficient removal of sawdust and particles created during cutting operations.

Secured to the plate 18 of the table 12 is an upstanding wall, or fence structure 68, having (in the embodiment of FIGS. 1–6) parallel planar faces 70 on its opposite sides. A steeply inclined slot 72 is formed through the forward end portion of the wall 68, and receives the screw 74 of a clamping mechanism having an operating knob 76 accessible at its upper end. A rabbet clamping lug 78 has portions extending laterally outwardly beyond the opposite faces 70 of the wall 68, and has a central threaded aperture (not visible) by which it is engaged on the screw 74. Turning of the knob 78 will therefore raise and lower the lug 78, enabling it to clamp a pair of frame pieces "F" (shown in phantom line in FIGS. 1 and 2) against the upper surface of the plate 18 and with one piece "F" resting against each face 70 of the wall 68; normally, the back surfaces of the frame pieces will contact the faces 70 and the outside surfaces thereof will lie upon the plate 18. A stop element 86 is affixed at the forward end of the plate 18, and serves to engage the lower corners of both frame pieces under the lip that it provides. The lug 78 is elongated, to impart stability to the clamped frame piece, and it has a rib formed along its outer lower edge for enhanced engagement.

A U-shaped implement, generally designated by the numeral 80 and most fully shown in FIG. 3, may be mounted in inverted relationship over the top edge 82 of the wall 68 with its opposite legs 84 bearing upon the surfaces 70. As can be seen from FIG. 1, with the implement 80 in place the frame pieces "F" are caused to converge toward one another (and toward the plane on the center line of the machine) in the forward direction (i.e., toward the motor mount).

Figure 1:
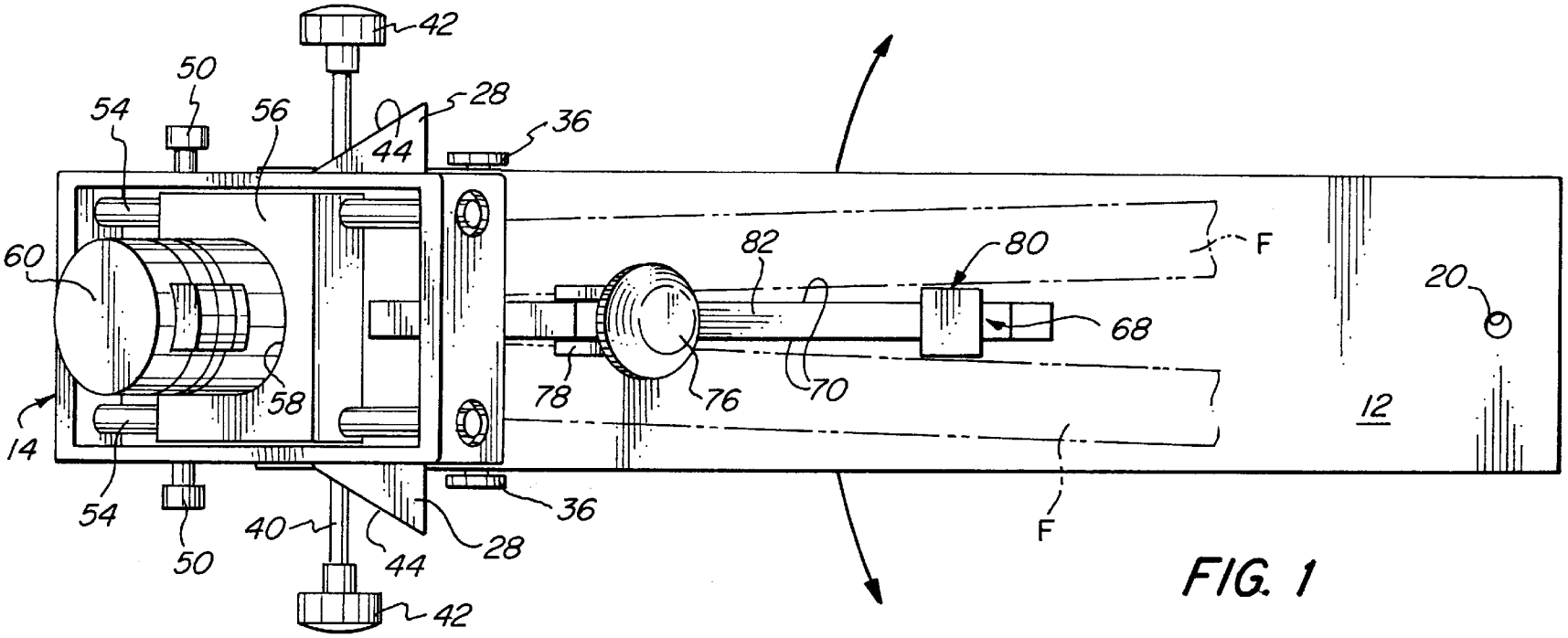
FIG. 1 is a plan view of a channel-cutting machine embodying the present invention.

In preparation for cutting of channels in two frame pieces simultaneously, they are mounted, as depicted in FIGS. 1 and 2 and as described, against opposite sides of the wall 68 (and hence to opposite sides of the machine center line), with the router bit 64 disposed between them and with its axis substantially perpendicular to the bevelled surfaces of the end portions (as achieved by angular adjustment of the motor mount 14); the bit will also lie in a plane on the machine center line, which plane is perpendicular to the surface of the plate 18 and toward which plane the pieces "F" converge. Pivoting of the table 12 in opposite directions about the pin 20 (as indicated by the arrows in FIG. 1), with the router in operation, will cause the bit 64 to form channels in each of the frame pieces alternatingly, the channels following a curvilinear path due to the arcuate movement of the table; the radius "X" of the arc, indicated in FIG. 2, will preferably be at least 17 inches long and will not generally exceed 21 inches. The forward convergence of the frame pieces produced by the implement 80 will cause the depth variation in the channel formed to further increase, from the point of entry of the router bit into the frame piece.

Figure 8:
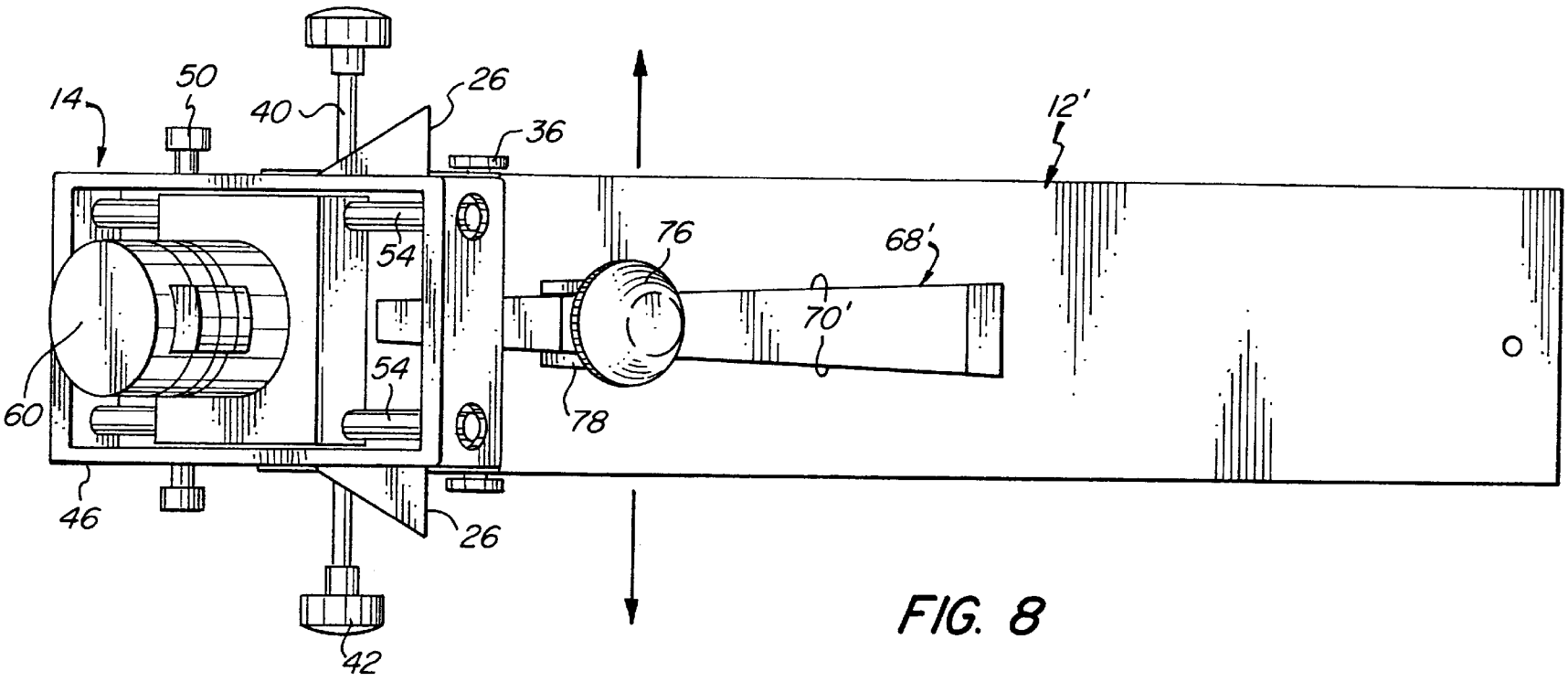
FIG. 8 is a view similar to FIG. 1, showing a modified form of the machine.

The machine illustrated in FIG. 8 of the drawings is virtually the same as that of the preceding Figures, except for the structure of the upstanding wall and for the manner of table movement. More particularly, the wall, generally designated the numeral 68', has lateral surfaces 70' which converge toward the center line of the machine and toward one another, in the forward direction. Consequently, frame pieces supported against the surfaces 7' will be disposed in a convergent relationship. As will be appreciated, the effect achieved is comparable to that which results from the presence of the implement 80 on the parallel-sided wall 68 of the previous embodiment, albeit that the angle of convergence can be changed by repositioning of the implement 80.

It should be emphasized that both the pivotable mounting of the table, and also the convergent disposition of the frame pieces, cause the channels cut in a frame piece to increase in depth as the cut proceeds. Consequently, objects of the invention can be achieved utilizing a machine having a rotating table on which the upstanding wall has unaltered, parallel surfaces. Alternatively, a cut of increasing depth can be produced by effecting relative rectilinear movement between the frame pieces and the router bit, on an axis perpendicular to the center line, with the frame pieces disposed in the convergent relationship described, as is suggested by the arrows in FIG. 8; suitable means for guiding rectilinear movement of the table 12' will be evident to those skilled in the art, and is not therefore shown in detail. It will also be appreciated that, irrespective of whether the relative movement is arcuate or rectilinear, it can be achieved by movement of either the supporting table or the router and its supporting structure, or both.

Turning now to FIGS. 9–12 in greater detail, the frame pieces "F" are characterized as having a rear surface 90, a front surface 92, an inside rabbet surface 94 and an outside surface 96; the thickness dimension is taken to be that which extends between the rear and front surfaces 90,92, and the width dimension is taken as that which extends between the surfaces 94 and 96. An end face 98 extends in a plane that is perpendicular to the rear surface 90, and at an angle of 45° to the outside surface 96 (and 135° to the inside surface 94). Each cut channel consists of a groove portion 100 and a connecting slot 102, extending in the thickness direction of the frame piece from a point of entry on the rear surface 90, the slot portion 102 additionally opening on the end face 98. The cut channel proceeds along a curvilinear path, which lies at progressively increasing distances from the end face 98 (i.e., in the length direction of the frame piece) as it extends in the thickness of the piece; such a curvilinear path would be produced by effecting relative pivotal or arcuate movement between the frame pieces and the cutting bit.

As depicted in FIG. 11, two frame pieces "F" are assembled with their end faces 98 in mutual contact, and with the pieces themselves in a generally coplanar relationship to one another. The channels formed in the end portions of the end pieces are aligned with one another, with the slot portions 102 thereof in substantial registry, cooperatively forming a recess into which may be inserted the fastening peg generally designated by the numeral 104, which is most fully illustrated in FIG. 9.

More particularly, the peg 104 consists of two lateral engagement portions 106, which extend parallel to one another, interconnected by a panel portion 108. It has a leading end 110, to which the panel portion extends fully, and a trailing end 112, the leading end portion having champfers at 114 to facilitate entry into the aligned channels.

Because of the divergence of the groove portions 100 (the innermost ends of which are designated 1001 in FIGS. 11 and 12), increasing levels of compressive force are generated on the frame pieces, by the parallel engagement portions 106, as the peg is driven more deeply into the recess formed by the channels. This of course exerts an effective closing force at the joint between the frame pieces, and serves to eliminate, or at least reduce, any gap that might otherwise be present therebetween. Extending the panel portion 108 fully to the leading end of the peg provides reenforcement thereat and prevents fracture or distortion of the peg at the location where greatest strength is required.

A second form of peg, generally designated by the numeral 116 and highly suitable for use in the practice of the invention, is illustrated in FIG. 13. It is similar to peg 104 in having parallel engagement portions 118, a full-length connecting panel portion 120, a leading end and a trailing end 122 and 124, respectively, and champfered lead-in surfaces 126. It differs primarily in that the opposite transverse faces 128 of the engagement portions 118 are flat. The shoulder surfaces 130' are of course functionally equivalent to the surfaces 130 of the peg 104, in that they bear upon the tapered surfaces of which the channel groove portions 100 are comprised.

Thus, it can be seen that the present invention provides a novel machine for cutting channels in end portions of frame pieces, which pieces are to be assembled with one another utilizing a connecting peg or fastener. The machine is adapted to cut channels of unique character, which channels cooperate in a highly effective manner with a peg fastener in producing a tight joint between adjacent frame pieces, and the machine is of relatively uncomplicated design, is of economical manufacture, and is facile and convenient to employ. The invention also provides a novel method for cutting channels of unique character into end portions of frame pieces, which channels cooperate in a highly effective manner with a peg fastener to produce a tight joint in assembly thereof, and the method is relatively uncomplicated, facile, and convenient to employ.

Having thus described the invention, what is claimed is:

1. A support assembly for supporting at least one elongate member, said support assembly including an elongate first component comprised of a base wall and an upstanding wall providing first and second surface portions, respectively, adjacently disposed in first and second mutually perpendicular planes with said first surface portion extending laterally from said second surface portion; and a second component disengageably mounted on said upstanding wall and providing at least a first contact portion with a first surface element spaced laterally away from said second plane and disposed proximate said first surface portion of said base wall, said first surface element of said first contact portion and an element of said second surface portion of said upstanding wall lying on a third plane that is mutually perpendicular with said first plane and is convergent with said second plane, said surface elements of said first contact portion and said second surface portion, and said first surface portion on said base wall, being configured to provide support for an elongate member abutted thereagainst.

2. The support assembly of claim 1 wherein said second surface portion is a planar surface.

3. The support assembly of claim 1 wherein said upstanding wall projects from said base wall.

4. The support assembly of claim 3 wherein said upstanding wall has two opposite sides, one of said sides comprising said second surface portion and the other of said sides comprising a third surface portion, and wherein said upstanding wall is so disposed as to provide an area of said first surface portion lying to each of said sides of said upstanding wall, said third surface portion being disposed in a fourth plane; and wherein said second component provides a second contact portion with a second surface element spaced laterally away from said fourth plane and disposed proximate the underlying one of said areas of said first surface portion of said base wall, said second surface element of said second contact portion, and an element of said third surface portion of said upstanding wall, lying on a fifth plane that is mutually perpendicular with said first plane and is convergent with said fourth plane, said surface elements of said second contact portion and said third surface portion being configured to provide support for an elongate member abutted thereagainst.

5. The support assembly of claim 4 wherein said second and third surface portions are both planar surfaces.

6. The support assembly of claim 4 wherein said second component is a U-shaped piece, dimensioned and configured to seat on said upstanding wall and to provide said first and second contact portions.

* * * * *